United States Patent [19]

Voltmer et al.

[11] Patent Number: 4,473,430

[45] Date of Patent: Sep. 25, 1984

[54] REEL AND SPLICE STAND FOR WEB OF LABELS

[75] Inventors: Helmut Voltmer, Park Ridge, N.J.; Robert A. LeDuc, West Lebanon, N.H.

[73] Assignee: NJM Inc., Fairfield, N.J.

[21] Appl. No.: 466,591

[22] Filed: Feb. 15, 1983

[51] Int. Cl.[3] ..... B31F 5/06; B65H 69/06

[52] U.S. Cl. ..... 156/504; 156/502; 156/505; 242/58.1

[58] Field of Search ..... 156/157, 159, 502, 504, 156/304.3, 505; 242/58.1, 58.3

[56] References Cited

U.S. PATENT DOCUMENTS

| | | | |
|---|---|---|---|
| 2,606,136 | 8/1952 | Garrett et al. | 156/504 |
| 3,873,396 | 3/1975 | Rice | 156/504 |
| 3,957,567 | 5/1976 | Pursell et al. | 156/159 |
| 4,203,796 | 5/1980 | Larsson | 156/504 |

*Primary Examiner*—Michael G. Wityshyn

*Attorney, Agent, or Firm*—Charles E. Baxley

[57] ABSTRACT

A machine for the splicing and dispensing of web carrying labels includes a plurality of supports upon which a set of reels of web can be unwound. A splicing table and a motorized web drawing station are located along a path of travel of web from the set of reels. A well and tray are provided for holding a sufficient quantity of web to meet demand during a splicing operation wherein the feed of web is switched from an empty reel to a full reel.

8 Claims, 2 Drawing Figures

REEL AND SPLICE STAND FOR WEB OF LABELS

BACKGROUND OF THE INVENTION

This invention relates to packaging equipment and, more particularly, to equipment for use in applying labels to packages wherein a web of labels is dispensed from a dual roll stand equipped for splicing rolls of the web.

Labels are dispensed in large numbers in the packaging industry. In order to make the labels readily available for both automatic and manual application of the labels to the packaging, the labels are dispensed by means of rolls of labels. Typically, the labels are secured adhesively to a flexible web which is wound on reels.

A problem arises in that, while the labels must be available continuously for the labeling process, the reels from which they are dispensed are of limited length. Thus at the end of the reel, the unwinding of the reel must terminate; however, the need is present for the continuous dispensing of the labels even though a reel of the labels has been consumed.

It is also apparent that there is a need for removal of a used reel and a renewed dispensing from a fresh reel, all this without any cessation of the dispensing of the labels.

SUMMARY OF THE INVENTION

The foregoing problems are overcome, and other advantages are provided by a reel and splice stand constructed in accordance with the present invention. The invention provides a splicing table wherein the end of one reel of label web can be spliced to the next reel of label web. The process of splicing is accomplished manually with the aid of clamps which hold the ends of the two reels which are to be spliced. The stand has the advantage of being portable, and includes rotatable supports for two reels.

An important feature of the invention is inclusion of a storage well within the stand having a fan which draws the web into the well for storage therein, while allowing an end of the web to be drawn from the well for dispensing of the labels. The well carries a sufficient supply of web to provide adequate time for an operator to manually splice the ends of two reels of the web whereby the web can be dispensed continuously even during the splicing period. Adjustable brakes are applied to shafts supporting the reels in order to create a desired amount of retardant force during the unwinding of the web. Photoelectric sensors located at the well sense the amount of web within the well, the sensors being electrically connected to a drive motor to facilitate replenishment of supply of web in the well.

A tray also is provided for further storage of unwound web, the tray preceding the well along the path of travel of the web. Thus after unwinding from a reel, the web is deposited within the tray. A set of pull rolls are driven by the electric motor for pulling web out of the tray and depositing the web in the well.

An important feature of the invention is found in the placement of the two reels relative to the splicing table and to the set of pull rolls. This arrangement provides for the locating of the splicing table and the pull rolls at a site equidistant from the two reels. Thereby feeding of web can be accomplished from either one of the reels. Also the splicing of one reel to the next reel can be accomplished irrespectively of whether the first reel is supported by the first shaft or supported by the second shaft of the two reel-supporting shafts.

BRIEF DESCRIPTION OF THE DRAWING

The foregoing aspects and other features of the invention are explained in the following description taken in connection with the accompanying drawing wherein.

DETAILED DESCRIPTION

Figure 1:
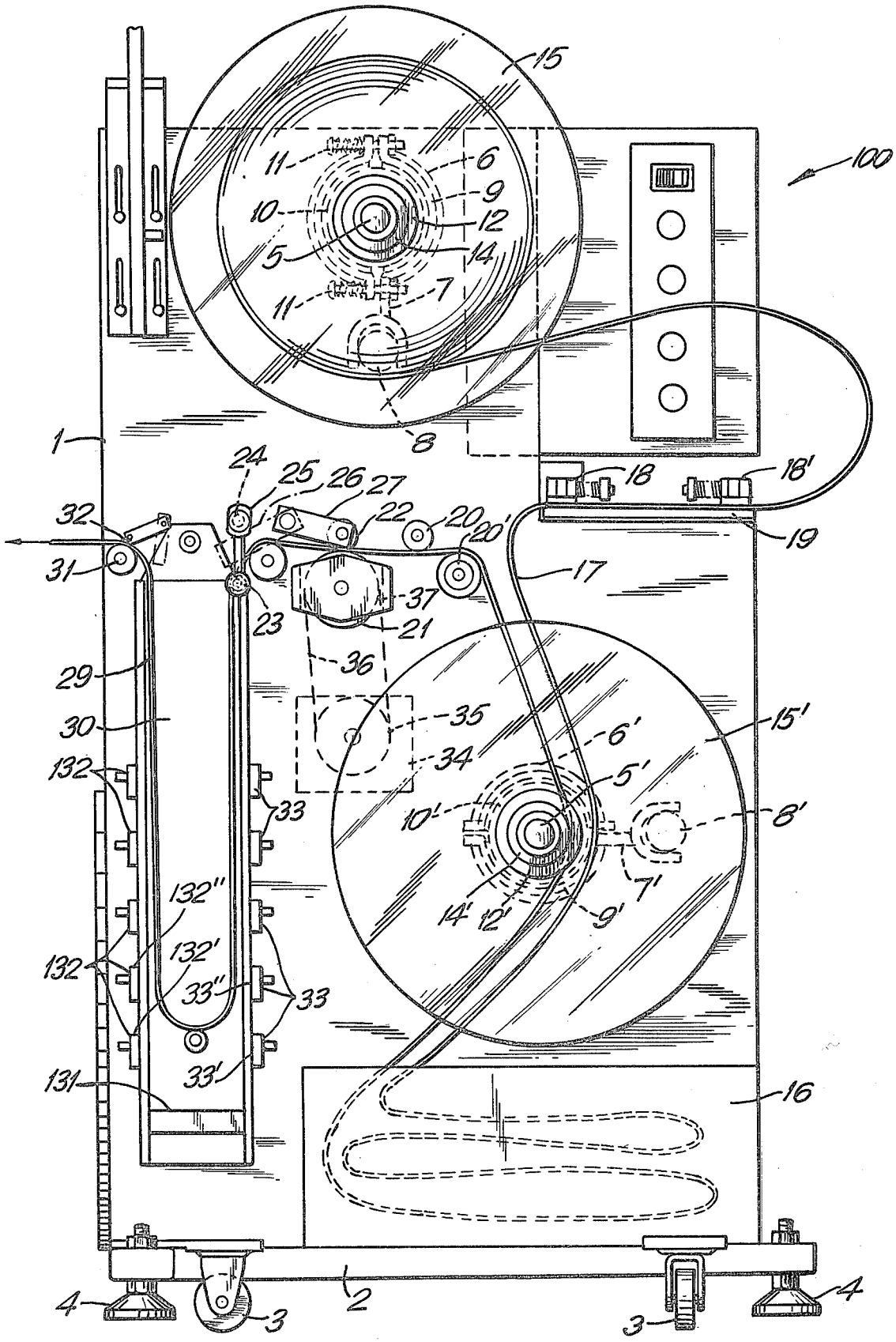
FIG. 1 is a front elevational view of the reel and splice stand of the invention.
Figure 2:
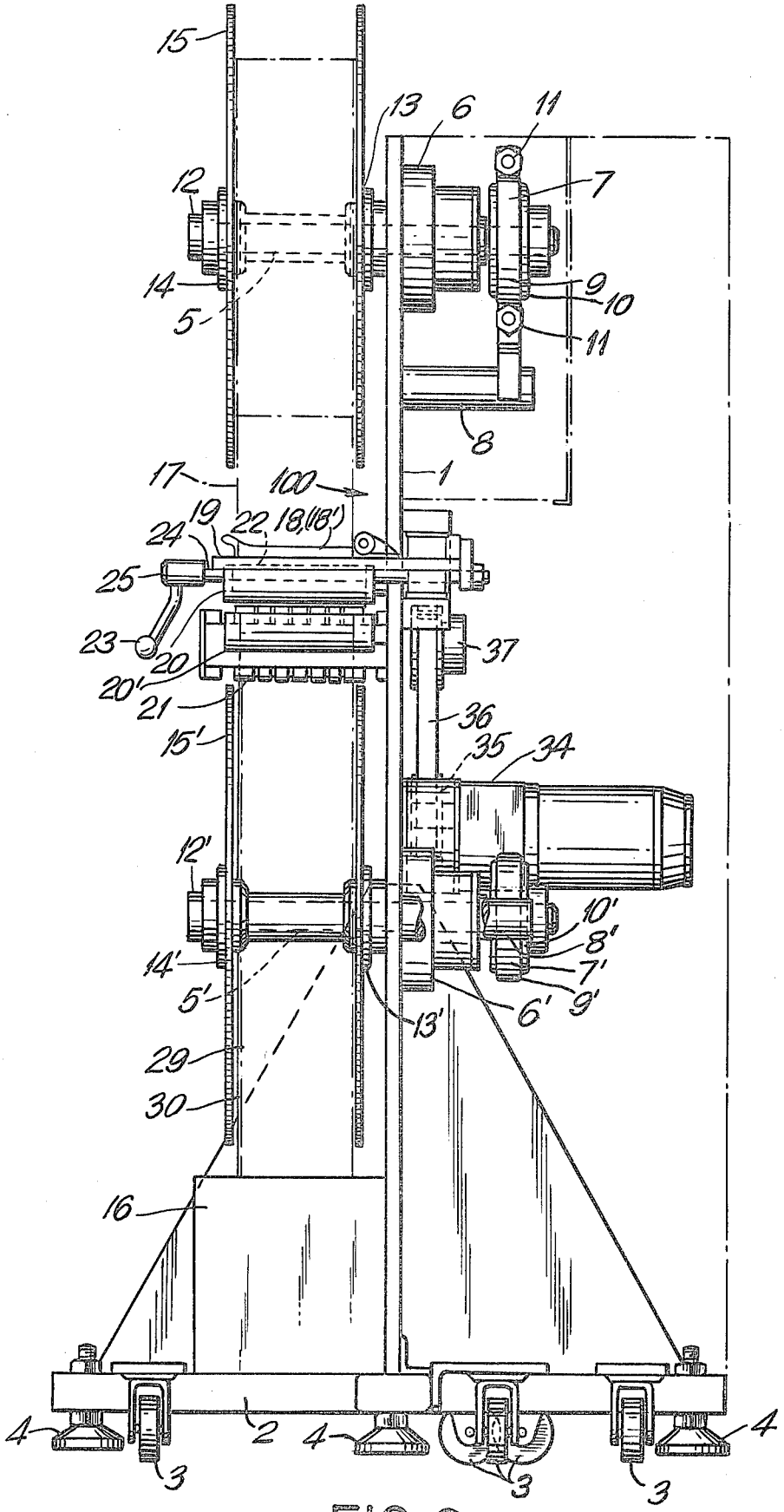
FIG. 2 is a side elevational view of the stand of FIG. 1.

As shown in FIGS. 1 and 2, the invention comprises a stand supporting a set of wheels and a web-feeding structure to permit dispensing of a web of labels even during the period of time in which the end of one reel is being spliced to the beginning of the next reel. There is substantial symmetry in the constructions of the two shafts which support the reels and accordingly the following description of the invention can be facilitated by utilization of common numerical legends for identifying the corresponding parts of the reel supporting structure. The numerals without primes are used to identify the upper reel and its supporting rotation mechanism, while the same numerals followed by the prime sign are utilized in identifying the lower reel and its supporting rotation mechansim.

As may be seen by reference to the two views of FIGS. 1 and 2, a stand 100 is constructed in accordance with the invention for the unwinding and splicing of a web of labels while providing for dispensing of the web of labels. The stand 100 comprises a frame member 1 mounted on a base 2 which, in turn, is supported on castors 3 upon which the stand 100 may be transported readily to a desired location. Alongside the castors 3, and connecting with the base 2, are leveling pads 4 which are utilized for leveling the stand 100 at the site wherein the dispensing of the labels is to take place.

The stand 100 carries a plurality of rolled label-web supports comprising roll support shafts 5 and 5'. The shafts 5 and 5' are braked adjustably in a manner to be described, and are mounted in bearings 6 and 6' for easy rotation. The brake function is accomplished with adjustable torque brake assemblies 7 and 7' mounted at one end respectively of each of the shafts 5 and 5'. One end of each of the brake assemblies 7 and 7' is anchored respectively at anchor studs 8 and 8' to prevent the brake shoes 9 and 9' of the assembly 7 and 7' from rotating with brake drums 10 and 10' of the assemblies 7 and 7'. The drums 10 and 10' are fastened respectively to the shaft 5 and 5'.

The brake torque applied to the shafts 5 and 5' is varied by use of pairs of adjusting screws 11 which connect respectively with the shoes 9 and 9'. At the ends of each of the respective shafts 5 and 5' opposite the brake ends, there are located support hubs 12 and 12' which carry flanges 13 and 13'. The hubs 12 and 12' also carry removable flanges 14 and 14'. The set of flanges 13 and 14, as well as a set of flanges 13' and 14', serve to guide the edges of rolls of labels, such as the label rolls 15 and 15' as these rolls unwind.

The base 2 also supports a tray 16 which serves to carry a supply of unwound label web 17 which has been pulled by hand from one of the rolls 15 or 15', which has been used as a source of label supply. It is understood in operation of the stand 100 that the label web 17 is dispensed alternately from a roll 15 on the shaft 5 and a roll 15′ on the shaft 5′. Thus the manual operation of pulling the web 17 from a roll 15 or 15′ is accomplished alternately by use of the upper roll 15 or the lower roll 15′. The manual pulling continues until the supply of labels in the dispensing roll diminishes, at which time preparation must be made for the mounting of the second roll on the stand 100 followed by the splicing together of the ends of the webs of the rolls.

With respect to the splicing operation, the end of the supply roll 15 or 15′ is clamped respectively by a clamp 18 or 18′ on to a splice table 19. The splice table 19 is mounted on a hinge pin extending from the frame 1 in order to be swung out of the web path during the periods of time when it is not being used for the splicing. In addition the splice table is equipped with guides for alignment with the clamped trailing end of the nearly depleted roll of labels with the leading edge of the fresh roll of labels. These two ends overlap on the table surface, so that the trailing edge of one roll is superimposed over the leading edge of the second roll with the labels on the webs of the respective rolls being in registration.

During the splicing operation, a knife edge is drawn across the overlapped region of the clamped web ends, the knife edge being guided by a score mark on the table surface. Thereafter the excess material from the cutting by the knife is removed, thereby leaving the front edge of the first label in the new roll abutting the trailing edge of the last label in the depleted roll. A piece of adhesively coated tape then is applied across the clamped portions of the web material to fasten the ends of the respective webs together. Thereupon the splice-table clamps are released to free the spliced section of web. The splice table 19 then is swung up out of the path of the web 17.

A set of rolls is provided for the automatic drawing of the web. These rolls include guide rolls 20 and 20′, a pull roll 21 and a clamping roll 22. The leading edge of the label web is fed between the guide rolls 20 and 20′, the web then passing between the pull roll 21 and the clamping roll 22. In order to insert the web between the rolls 21 and 22, these two rolls first must be separated from each other. This is accomplished by means of a clamp opening handle 23 on the end of a rotatable shaft 24 connecting with an eccentric 25. The eccentric 25 is located on the end of the shaft 24 away from the handle 23. The eccentric 25 rides against a lever 26 which is mounted on a lever 27, the latter being supported pivotally for movement in response to the force of the eccentric 25. Releasing of the eccentric force opens a gap between the pull roll 21 and the clamping roll 22. Thereafter the leading edge of a section 29 of the web can be passed through the gap between the rolls and into a storage well 30. By application of the handle 23, the pull roll 21 and the clamping roll 22 can again be brought together to grip the web section 29. The web section 29 may be looped through the supply well 30 and then passed between a guide shaft 31 and a tensioning brush 32. The guide shaft 31 and the brush 32 provide a point of entry of the label web into such equipment as may require label feed.

As the dispensed label feed is being drawn from the supply well 30, suction is created in the well 30 by air from an exhaust fan 131, the suction tending to draw the section 29 of web down into the well 30 in an orderly manner which permits the web to be suspended neatly within the well 30, so as to permit measurement of the web to be made by photoelectric devices for automatic feeding of the web to the well as it is dispensed via the guide shaft 31 and the brush 32. The photoelectric measurement is accomplished with the aid of light sources 132, individual ones of which are further identified as 132′, 132″, the light of which impinges on photoelectric cells 33, individual ones of which are further identified as 33′, 33″.

A motor 34 is provided for driving the pull roll 21. The connection between the motor 34 and the pull roll 21 is attained by a pulley 35 on the motor shaft, a belt 36 engaging with the pulley 35, and a pulley 37 located on a common shaft with the pull roll 21 and engaged with the belt 36. A well known electric circuit, not shown, is responsive to electric signals of the cells 33 for activating the motor 34 in response to the position of the web within the well 30. Thus as the web rises within the well 30, the lowest beam of light from the source 132 impinges upon the cell 33 to activate the motor to drive a pull roll 21. In the event the web is withdrawn rapidly from the well 30, and accordingly rises up past other ones of the sources 132, such as the source 132′ and the source 132″, further beams of light impinge upon the cells 33 such as the cells 33′ and 33″, resulting in a rapid acceleration of the motor 34 more rapidly to draw webbing via the pull roll 21 into the supply well 30, so that the average rate of dispensing of the web meets the average demand of the equipment requiring the label fed. Thus the supply well 30 maintains a regulated supply of label web in its hold, and the external equipment utilizing the label feed have, at all times a constantly tensioned web of labels ready for use upon demand. The two supply rolls of labels in combination with the tray 16 and the splice table 19 enable replenishment of label web rolls without interference with the dispensing of the labels at a rate equal to the demand for the labels.

In operation a person utilizing the stand 100 for the dispensing of a web of labels places a label roll on either the shaft 5 or 5′, and feed the web through the pull roll 21 and the clamping roll 22 for filling the well 30 with a supply of the label web. The end of the labels is passed between the guide shaft 31 and the tensioning brush 32 through which the web is dispensed to external equipment utilizing the labels. During use of the labels the web is drawn passed the brush 32, and replenishment of the amount of web in the well 30 is accomplished by the driving of the pull roll 21 by the motor 34 in response to electric signals from the photoelectric cells 33. When the well 30 is full with a section 29 of the web, light from the light source 132 is shaded by the web so as not to impinge upon the photoelectric cell 33. As the well 30 begins to empty of the web section 29, light from the source 132 impinges upon the cell 33 to activate the motor 34 to drive the pull roll 21 for refilling the well 30 with web. In event of rapid use of the web by external equipment, light from additional ones of the sources 132 impinge upon additional ones of the cells 33 to drive the motor 34 at a higher rate of speed, so as to insure that the supply of the web matches the demand therefore.

When the end of a roll 15 or 15′ is approaching, the operator installs an additional roll 15′ or 15 on the empty shaft 5′ or 5, and clamps the beginning of the new roll on the table 19 by means of a clamp 18′ or 18. The end of the previous roll, 15 or 15′ is then clamped to the table 19 by clamp 18 or 18′ so as to permit the splicing operation to be performed manually while the remaining supply of web is dispensed from the tray 16 and the well 30. Sufficient time elapses during the dispensing of the extra supply of web from the tray 16 and the well 30 to allow the manual splicing operation to take place on the table 19. Thereupon, the clamps 18 and 18' are released and swung up out of the way and the web 17 is fed automatically from the new roll 15' or 15 through the tray 16 and via the rolls 21 and 22 into the well 30.

It is to be understood that the foregoing described embodiment of the invention is only illustrative, and that within the teaching of this disclosure modifications of the described embodiment will occur to those skilled in the art to which this invention pertains. Accordingly, this invention is not to be regarded as limited to the embodiment described herein, but is to be limited only as defined by the claims appended hereto.

We claim:

1. A web dispensing and splicing machine comprising:

a web splicing station for splicing together ends of webs carried by reels;

means for supporting said reels at sites positioned substantially uniformly about said splicing station;

a web drawing station positioned at a location substantially uniformly distant from each of said reel supporting sites, an input end of said drawing station being directed for receiving a web alternately from each of said reels;

web storing means, said web storing means and said web splicing station being disposed along a path of travel of said web between said reels and said drawing station with an output end of said splicing station being directed for transmission of said web to said storing means; and means connecting with said drawing station for regulating a rate of said web drawing to match an average speed of dispensing of said web with a rate of demand of said web, said storing means storing a sufficient amount of web to supply said drawing station during a web splicing operation at said splicing station.

2. A machine according to claim 1 wherein said regulating means includes a well for holding the web and means for sensing the amount of the web in said well, said drawing station including a motor and a web engaging pulley driven by said motor, and wherein the speed of said motor is responsive to signals of said amount sensing means.

3. A machine according to claim 2 wherein said storing means is a web gathering tray, said tray being disposed beneath said input end of said drawing station for feeding web thereto.

4. A machine according to claim 3 wherein the amount of web held in said well plus the amount of web supported in said tray is sufficient to meet the demand for the web during the duration of a web splicing operation at said splicing station.

5. A machine according to claim 1 wherein said web carries labels and wherein said splicing station includes a table which is configured for guiding a cutting of web between labels during said splicing operation.

6. A web dispensing machine comprising:

a web splicing station for the splicing together of ends of webs carried by reels;

web drawing means for drawing web from one of said reels at an average rate commensurate with an average demand for the web;

means for supporting said reels at locations from which web can be alternately fed from individual ones of said reels to said splicing station and to said web drawing means; and means disposed along a path of travel of said web through said drawing means and being positioned between said splicing station and said drawing means for storing a sufficient amount of said web to meet the demand for the web during a web splicing operation at said splicing station.

7. A machine according to claim 6 further comprising means for regulating a speed of web drawing by said drawing means, said regulating means including a sensor of an amount of web contained within said storing means, said sensor including means for signaling a change in said speed.

8. A machine according to claim 7 wherein said web carries labels, and wherein said splicing station includes a table which is configured for guiding a cutting of web between labels during said splicing operation.

* * * * *